US006543457B2

(12) United States Patent
Maiwald et al.

(10) Patent No.: US 6,543,457 B2
(45) Date of Patent: Apr. 8, 2003

(54) APPARATUS FOR APPLYING ADHESIVE TO A RUNNING WEB OF WRAPPING MATERIAL FOR SMOKERS PRODUCTS

(75) Inventors: Berthold Maiwald, Marschacht (DE); Torsten Mörke, Dissau (DE); Karl-Heinz Pawelko, Schwarzenbek (DE)

(73) Assignee: Hauni Maschinenbau AG, Hamburg (DE)

( * ) Notice: Subject to any disclaimer, the term of this patent is extended or adjusted under 35 U.S.C. 154(b) by 0 days.

(21) Appl. No.: 09/876,139

(22) Filed: Jun. 8, 2001

(65) Prior Publication Data

US 2002/0020419 A1 Feb. 21, 2002

(30) Foreign Application Priority Data

Jun. 8, 2000 (DE) ..... 100 28 000

(51) Int. Cl.[7] ..... A24C 1/26; A24C 5/08; A24C 5/47

(52) U.S. Cl. ..... 131/34; 131/35; 131/58; 131/69; 131/905

(58) Field of Search ..... 131/281, 32, 33, 131/28, 35, 37, 58, 59, 69, 905, 908, 910, 34

(56) References Cited

U.S. PATENT DOCUMENTS

| | | | | |
|---|---|---|---|---|
| 4,281,670 A | | 8/1981 | Heitmann et al. | |
| 4,491,490 A | * | 1/1985 | Ehret et al. | 118/663 |
| 4,845,374 A | * | 7/1989 | White et al. | 250/559.24 |
| 4,889,140 A | | 12/1989 | Lorenzen et al. | |
| 5,054,346 A | | 10/1991 | Heitmann | |
| 5,135,008 A | | 8/1992 | Oesterling et al. | |
| 5,341,824 A | * | 8/1994 | Fletcher et al. | 131/281 |
| 5,735,292 A | | 4/1998 | Draghetti | |
| 5,769,947 A | | 6/1998 | Krappweis | |
| 6,173,716 B1 | * | 1/2001 | Okumoto | 131/84.1 |
| 6,325,068 B1 | * | 12/2001 | Dombek et al. | 131/280 |

FOREIGN PATENT DOCUMENTS

| | | |
|---|---|---|
| DE | 1 805 075 | 9/1970 |
| DE | 39 18 137 | 12/1989 |
| DE | 44 37 764 | 4/1996 |
| EP | 1161888 A2 * | 12/2001 |
| JP | 57-34991 | 11/1980 |

* cited by examiner

*Primary Examiner*—Steven P. Griffin
*Assistant Examiner*—Carlos Lopez
(74) *Attorney, Agent, or Firm*—Venable LLP; Robert Kinberg; Chad C. Anderson

(57) ABSTRACT

The application of adhesive to selected non-perforated sections of one side of a running web of tipping paper in a filter cigarette making machine is carried out in such a way that the adhesive is invariably applied only to the non-perforated sections which alternate with perforated sections. To this end, the speed of advancement of the web along its path past an adhesive applicator and thereupon through a severing unit (which subdivides the web into a file of successive uniting bands to be wrapped around filter mouthpieces and plain cigarettes) is temporarily altered when a comparison of first signals denoting detection of successive perforated sections of the running web with second signals denoting the frequency of severing of the web in the severing unit indicates the need for a temporary change of the speed of the web upstream of the adhesive applicator. The latter is installed at a fixed distance from the severing unit.

17 Claims, 2 Drawing Sheets

APPARATUS FOR APPLYING ADHESIVE TO A RUNNING WEB OF WRAPPING MATERIAL FOR SMOKERS PRODUCTS

CROSS-REFERENCE TO RELATED CASES

The present application claims the priority of the commonly owned copending German patent application Serial. No. 100 28 000.5 filed Jun. 8, 2000. The disclosure of the above-referenced German patent application, as well as that of each US and foreign patent and patent application identified in the specification of the present application, is incorporated herein by reference.

BACKGROUND OF THE INVENTION

The invention relates to improvements in methods of and in apparatus for applying an adhesive substance, such as a hotmelt, to selected portions or sections of one side of a running web or strip of paper or other wrapping material in a machine wherein the web is converted into a continuous or discontinuous tubular wrapper or envelope surrounding a rod-shaped filler. A presently preferred application of the improved method is in machines which are designed to turn out filter mouthpieces for tobacco stoke, filter cigarettes, plain cigarettes and similar rod-shaped smokers' products.

It is customary to provide a web of cigarette paper or so-called tipping paper (sections of a web consisting of tipping paper are provided with longitudinally spaced-apart patterns of perforations for admission of atmospheric air into the tobacco smoke flowing from the lighted end of a filter cigarette, cigar or cigarillo to the mouth of the smoker) with films or layers of a suitable adhesive which bonds the marginal portions of a tube into a customary seam extending lengthwise of the smokers' product. The adhesive can also serve to bond the converted (finite) length of the web to the fragments of tobacco and/or to the normally fibrous filter material for tobacco smoke. The leader of the web is repeatedly severed upon completion of the application of adhesive to non-perforated portions of the leader to yield uniting bands which are convoluted around a filter mouthpiece and around the adjacent end portion(s) of one or two filter cigarettes to form therewith a filter cigarette of unit length or a filter cigarette of double unit length.

It is also known to provide a filter cigarette making machine (also called tipping machine) with a sensor which monitors the positions of adhesive patterns and generates signals serving to carry out or to initiate certain adjustments of the detected positions of the patterns of perforations (or of inidicia or markers denoting the positions of such patterns and being applied to the running webs) when the monitored positions; depart from the desired or preselected or required or optimum positions. Reference may be had to U.S. Pat. No. 5,735,292 (granted Apr. 7, 1998 to Draghetti for "METHOD AND DEVICE FOR THE PRODUCTION OF FILTER TIP BANDS FOR VENTILATED CIGARETTES") which describes and shows an apparatus for and discloses a method of applying adhesive films to non-perforated portions of running webs of tipping paper for use in filter cigarette making machines.

The patent to Draghetti discloses two embodiments of the aforesaid method. Each embodiment provides for a monitoring of the relationship between the angular position of a rotary drum-shaped adhesive applicator and the angular position of a rotary carrier for the knife or knives serving to sever the leader of the web upon completion of the application of adhesive to the foremost (not yet separated) uniting band. Any departures of the location of detected perforated zone from the desired or required location are compensated for by changing the angular position of the rotary knife carrier and/or by changing the extent of movement of the web between the adhesive applicator and the severing unit.

A drawback of the just discussed proposal of Draghetti is that a correction of the positions of adhesive-coated section relative to the locations of cuts across the web necessitates a change of the positions of adhesive-coated sections relative to the perforated patterns and vice versa. This involves the utilization of additional sensor means and the utilization of one or more additional control unit or units for the processing of signals being transmitted by additional sensors with attendant additional costs and increased space requirements of the patented apparatus, Furthermore, the patent to Draghetti does not, describe and/or illustrate such additional equipment including the sensor or sensors and the control circuits which would be capable of processing the signals furnished by the additional sensor(s). Therefore, and to the best of applicants' knowledge and belief, the patented proposal has failed to gain widespread acceptance in the tobacco processing industry.

OBJECTS OF THE INVENTION

An object of the present invention is to provide a novel and improved method which is not only simpler but also more reliable than heretofore known methods in that it facilitates the establishment of a long-lasting optimum relationship between the perforated pattern or patterns and the adhesive-coated portion or portions of each of a short or long series of uniting bands.

Another object of the invention is to provide a method which renders it possible to operate with a single control unit for signals being supplied by the sensors for various parameters requiring consideration in connection with the application of adhesive to uniting bands for use in filter cigarette making and analogous machines employing filter mouthpieces having tubular envelopes provided with patterns of perforation for the admission of atmospheric air.

A further object of the instant invention is to provide a method which can be practiced by resorting to apparatus employing novel combinations of available components.

An additional object of the invention is to provide a novel and improved apparatus for the practice of the above outlined method.

Still another object of the invention is to provide an apparatus which can be installed in existing filter tipping machines and other machines for the processing of running webs which are made of paper or the like and must exhibit accurately distributed adhesive bearing sections and uncoated sections.

A further object of this invention is to provide a filter tipping machine which embodies the above outlined apparatus.

Another object of the present invention is to provide novel and improved filter cigarettes or analogous smokers' products.

An additional object of the invention is to provide a novel and improved combination of adhesive applying, conveying, severing ad synchronizing means for use in filter tipping machines.

SUMMARY OF THE INVENTION

One feature of the present invention resides in the provision of a method of manipulating an elongated web of wrapping material (such as a web of tipping paper of the character utilized in many filter cigarette making machines) having a succession of longitudinally spaced-apart first sections (such first sections can be perforated, either entirely or in part) separated from each other by successive second sections which are to be at least partially coated with a flowable substance (such as a hotmelt or another suitable adhesive substance). The improved method comprises the steps of advancing the web lengthwise in a predetermined direction, along a predetermined path and at a predetermined speed, monitoring at least one first portion of the path and generating first signals at a first frequency denoting the detection of successive first sections, severing the web across successive second sections of the web in a second portion of the path downstream of (i.e., following) the first portion of the path to thus convert the web into a series of successive bands having predetermined lengths, scanning a third portion of the path downstream of the first portion to detect successive bands and generating a series of second signals at the frequency of detection of successive bands, comparing the first signals with the second signals to detect differences (if any) between the phases and/or other characteristics of the first and second signals, and temporarily altering the speed of the web when the comparing step indicates a phase difference exceeding a predetermined value, The improved method further comprises the steps of applying a flowable substance to successive second sections of the web in a fourth portion of the path downstream of the at least one first portion, and maintaining the first and fourth portions of the path at a fixed distance from each other.

The method can further comprise the step of ascertaining the spacing of successive first sections of the web from each other (this can take place in the at least one first portion of the path); the altering step of such method can be carried out when the spacing of successive first sections of the web from each other departs from a preselected value. This method can further comprise the step of ascertaining the speed of the web simultaneously with each ascertainment of the spacing of successive first sections of the web from each other.

The improved method can further comprise the step of applying flowable substance to successive second sections of the web following (i.e., subsequent to) the monitoring step and in a fourth portion of the path at a fixed distance from the second portion of the path. The just outlined method can further comprise the steps of generating third signals at a frequency corresponding to that of applying flowable substance to successive second sections, comparing the positions of phase of third signals only with the positions of phases of the second signals to ascertain the presence or absence of differences between the phases of the second and third signals, and temporarily altering the frequency of application of flowable substance to successive second sections of the web when the difference between the phases of the second and third signals departs from a preselected value, The advancing step can include entraining the web by the peripheral surface of at least one rotary advancing member (such as a roller which defines with a second roller a nip for the web): the step of temporarily altering the speed of the web can include changing the speed of the peripheral surface of the at least one advancing member.

The predetermined value can include or embrace a range of acceptable tolerances of differences between the phases of the first and second signals.

The method can further comprise the step of varying the distance between the first sections of the web in the at least one first portion and the second portion of the path in dependency upon detection of changes of the predetermined speed.

Another feature of the present invention resides in the provision of an apparatus for supplying a series of discrete perforated uniting bands of tipping material to a filter cigarette making machine. The improved apparatus comprises means for advancing—in a predetermined direction and along a predetermined path—an elongated web which consists (at least in part) of tipping paper and is provided with a series of at least partially perforated first sections which alternate with non-perforated second sections, means for applying a flowable adhesive to successive second sections of the web in a first portion of the path, means for severing the web across successive second sections in a second portion of the path downstream of the first portion to thus convert the web into a succession of discrete uniting bands, at least one first sensor which is adjacent a third portion of the path upstream of the second portion and is arranged to generate first signals denoting detection of successive first sections of the running web, at least one second sensor which is arranged to monitor the frequency of severing of the web in the second portion of the path, control means including a suitable circuit or other means for comparing the first signals with the second signals, and means for temporarily altering the speed of advancement of the web when the comparison of first and second signals reveals the presence or existence of deviations outside of a predetermined (acceptable) range.

The first and second portions of the path (i.e., the locations of the adhesive applying means and the severing means) can be disposed at a fixed distance from each other (as seen in the direction of advancement of the web along its path).

The improved apparatus can further comprise means for ascertaining the distances between successive first sections of the web and means for comparing the thus ascertained distances with a reference distance. The altering means of such apparatus is or can be arranged to temporarily alter the speed of advancement of the web in dependency upon the extent of departure of the ascertained distance from the reference distance. The means for ascertaining the distances can form part of one of the first and second sensors (such as the first sensor). The means for comparing the ascertained distances can form part of the aforementioned control means.

The third portion of the path can be located at a first fixed distance from and downstream of the first portion of the path and at a second fixed distance from and upstream of the second portion of the path.

The advancing means can comprise at least one roll or an analogous rotary advancing member having a peripheral surface which is arranged to contact and entrain the web in the predetermined direction, and the means for temporarily altering the speed of advancement of the web can include means (such as a variable-speed electric motor) for varying the peripheral speed of the at least one roll in response to appropriate signals from the control means.

The apparatus can further comprise at least one third sensor which is arranged to generate third signals denoting the frequency of application of flowable adhesive to successive second sections of the running web, means for comparing the third signals with the first and/or second signals, and means for temporarily altering the frequency of application of adhesive to the second sections of the running web when the comparison of the third signals with the first and/or second signals reveals the need for a change of the frequency of adhesive application. The aforementioned comparing means can form part of the control means or can constitute a discrete control means. In many instances, the first mentioned control means can include means for comparing the first signals only with the second signals.

The third sensor can be disposed in or at a portion of the path between the first and second portions of such path.

The first and/or second and/or third sensor can constitute a photoelectric detector or a proximity detector.

The novel features which are considered as being characteristic of the present invention are set forth in particular in the appended claims. The improved apparatus itself, however, both as to its construction and the modes of assembling, installing and operating the same, together with numerous additional important and advantageous features and attributes thereof, will be best understood upon perusal of the following detailed description of certain presently preferred specific embodiments with reference to the accompanying drawings.

DESCRIPTION OF PREFERRED EMBODIMENTS

Figures 1, 2:
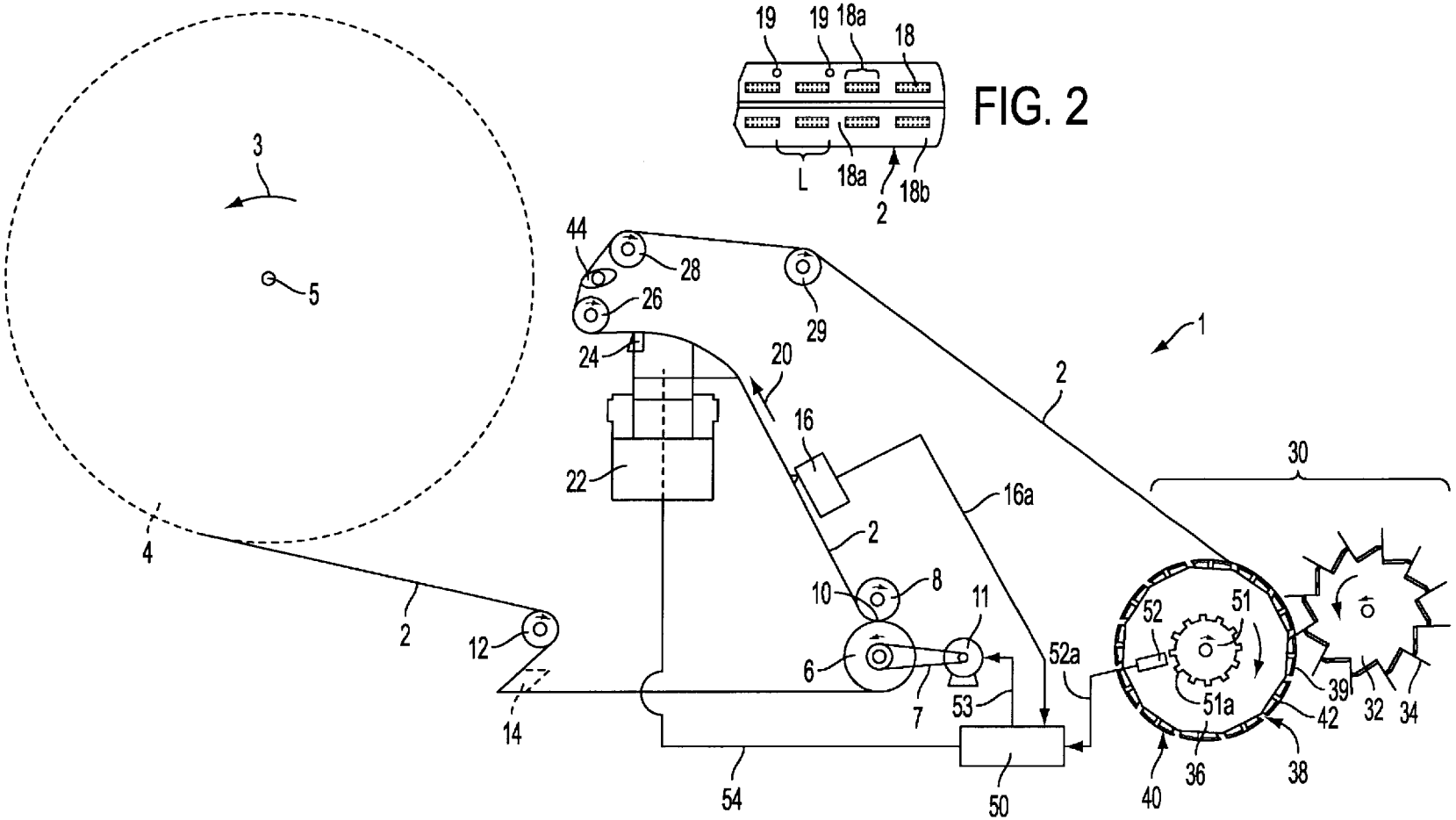
FIG. 1 is a somewhat schematic elevational view of an adhesive applying apparatus which embodies one form of the invention and can be utilized in a tipping machine for the makings of filter cigarettes and similar rod-shaped smokers' products.
FIG. 2 is a fragmentary plan view of a web of tipping paper which is provided with one presently preferred pattern of perforated and non-perforated sections.

FIG. 1 illustrates an apparatus 1 which forms part of a filter cigarette making machine (also called tipping machine), e.g., a machine of the type disclosed in U.S. Pat. No. 5,135,008 granted Aug. 4, 1992 to Oesterling et al, for "METHOD OF AND APPARATUS FOR MAKING FILTER CIGARETTES". The tipping machine of Oesterling et al. converts successive groups of three coaxial rod-shaped components (including plain cigarettes of unit length and a filter mouthpiece or filter rod section of double unit length between them) into filter cigarettes of double unit length. Such conversion is carried out by resorting to uniting bands made of so-called tipping paper and being convoluted around the mouthpiece and around the adjacent inner end portions of the plain cigarettes.

One side of each uniting band must be coated with a suitable adhesive substance (e.g., a hotmelt) in order to ensure that the converted band will adhere to the mouthpiece and to the plain cigarettes during halving of the filter cigarette of double unit length and subsequent manipulation of the thus obtained filter cigarettes of unit length (a) in the manufacturing plant (such as in a packing machine) and (b) by the smoker. It is customary to provide a web or strip 2 (see FIGS. 1 and 2) of tipping paper with arrays or patterns 18 of perforations which permit atmospheric air to enter the column of smoke flowing from the lighted end of a filter cigarette into the mouth of a smoker. Such air can readily penetrate through the tubular wrapper of the filter mouthpiece because the material of such wrapper is permeable to air to start with and/or is perforated independently of perforations made in the tipping paper. The manner in which a running web of cigarette paper or tipping paper can be perforated is disclosed, for example, in U.S. Pat. No. 4,281,670 to Heitmann et al. (granted Aug. 4, 1981 for "APPARATUS FOR INCREASING THE PERMEABILITY OF WRAPPING MATERIAL FOR ROD-SHAPED SMOKERS' PRODUCTS") and in U.S. Pat. No. 4,889,140 granted Dec. 26, 1989 to Lorenzen et al. for "APPARATUS FOR MAKING PERFORATIONS IN ARTICLES OF THE TOBACCO PROCESSING INDUSTRY".

FIGS. 2 shows that the patterns 18 of perforations are spaced apart from each other in the longitudinal direction (see the arrow 20 in FIG. 1) of the web 2, and that the (first) web sections 18A which are provided with patterns 18 of perforations alternate with second sections 18*a* which are devoid of perforations. Thus, and in order not to affect the effectiveness of the perforations, it is desirable and advantageous to provide with a suitable flowable adhesive (such as a hotmelt) only the sections 18*a* or the sections 18*a* plus the non-perforated parts or portions (18B) of the sections 18A.

FIG. 2 further shows that each section 18A has two patterns 18 of perforations. The reason is that, when a finished filter cigarette of double unit length is severed to yield two discrete filter cigarettes of unit length, each half of each converted (tubular) uniting band 39 (shown in FIG. 1) comprises a perforated pattern 18. The severing is carried out midway between each pair of patterns 18, namely along the double line 18C shown in FIG. 2. The width L of each uniting band 39 equals the combined width of a first section 18A and a section 18*a* or the combined Width of a first section 18A plus the combined width of two halves of two sections 18*a* flanking the first section. In a finished filter cigarette of unit length, the spaced-apart halves of two sections 18*a* overlie each other to form a seam which extends lengthwise of the filter cigarette.

Referring again to FIG. 1, the web 2 is drawn from a suitable source 4 here shown as a bobbin or reel which is rotatable relative to or with a shaft 5 to advance in the direction indicated by the arrow 20; this causes the reel 4 to turn in the direction of arrow 3. The web 2 is advanced by a pair of rolls 6, 8 and the roll 6 is driven by an adjustable prime mover 11 by way of an endless belt or chain 7. The roll 8 is an idler roll and is installed in such a way that successive increments of the web 2 advancing through the nip 10 of the rolls 6, 8 cannot slip relative to the peripheral surface of the roll 6. i.e., the web is caused to advance at the exact speed determined by the prime mover 11 e.g., a variable-speed electric motor) which is adjustable in response to signals transmitted (via conductor 53) by a control unit 50.

Prior to reaching the advancing rolls 6 and 8, successive increments of the running web 2 are deflected by an idler roller 12 and are treated by the edge of a so-called curling bar 14, namely an implement which enhances the flexibility of the web prior to conversion into tubular envelopes or wrappers surrounding one or two plain cigarettes and a filter mouthpiece.

The advancing rolls 6, 8 are followed by a detector or sensor 16 which serves to monitor the running web 2 for the presence of successive patterns 18 of perforations or indicia 19 (see FIG. 2) representing the patterns 18 and causing the sensor 16 to generate a succession or series of first signals at a frequency corresponding to the mutual spacing of successive patterns 18. The sensor 16 can constitute a light-responsive detector which is positioned to detect radiation passing through the perforations of successive patterns 18. Alternatively, the sensor 16 can be designed to respond to differences between the reflectivities of the patterns 18 of perforations and the reflectivities of web sections 18*a* which alternate with successive patterns 18. All that counts is to provide a sensor which can generate a series of suitable signals at the frequency of advancement of successive patterns 18 through the monitoring station adjacent that portion of the elongated path for the running web 2 which, in the apparatus 1 of FIG. 1, is located downstream of the advancing rolls 6, 8 and upstream of an adhesive applying unit or paster 22.

The illustrated sensor 16 (with means for monitoring the intensity of transmitted or reflected radiation) can be replaced with a so-called twin photoelectric call which is designed to ascertain the speed of forward movement of the pattern 18 as well as the frequency of advancement of successive patterns past the monitoring station. This enables the control unit 50 to calculate the distances L between the foremost ends of successive patterns 18.

The aforementioned adhesive applying unit or paster 22 is installed downstream of and at a predetermined distance from the sensor 16. This pastor comprises a nozzle 24 having one or more orifices (not specifically shown) which serve to apply to one side of the running web 2 a series of adhesive fields or layers or films which at least partially coat successive sections 18*a* and serve to cover those portions of successive future uniting bands 39 which are to adhere to the respective filter mouthpieces and plain cigarettes during conversion into tubular envelopes in the filter tipping machine.

The nozzle 24 of the paster 22 is or can be identical with that disclosed in U.S. Pat. No. 5,769,947 granted Jun. 23, 1998 to Krappweis for "APPLICATOR FOR ADHESIVE AND CORRESPONDING NOZZLE PLATE". For example, the nozzle 24 can be designed to apply adhesive to each and every portion of one side of the web 2 except the patterns 18 because the application of adhesive to such patterns could adversely affect their effectiveness; in fact, the adhesive could completely clog the perforations or could clog the perforations of one or more patterns differently from the other patterns. This would cause the wrappers of filter cigarettes to exhibit different resistances to the flow of air into the columns of tobacco smoke.

Those increments of the freshly coated web 2 which advance beyond the nozzle 24 are trained over idler rollers 26, 28, 29 on their way to a severing unit 30 which repeatedly severs the leader of the web to form a series of discrete uniting bands 39. This severing unit is installed at a fixed (predetermined) distance from the nozzle 24 of the paster 22 (as seen in the direction of the arrow 20). Owing to the selection of a fixed distance between the nozzle 24 and the severing unit 30, a single setting or adjustment of the paster 22 (i.e., of the locus or loci of discharge of paste through the orifice or orifices of the nozzle 24) suffices to ensure proper positioning of the applied adhesive films or images relative to the plane of the cuts which are carried out by successive knives 34 of an annular array of such knives at the periphery of a rotary knife carrier 32 of the unit 30.

The knives 34 cooperate with a drum-shaped counterknife 36 having a cylindrical peripheral surface 40 interrupted by equidistant axially parallel recesses or slots or gaps 38 for the cutting edges of the knives. The surface 40 is provided with suction ports (one shown at 42) which attract the uniting bands 39 on their way toward the band rolling or convoluting station of the tipping machine in a manner well known in the art of transporting uniting bands in tobacco processing machines. The knives 34 extend close to but not exactly radially of the knife carrier 32; the latter is driven counterclockwise and the counterknife 36 is driven clockwise (as seen in FIG. 1). The suction ports 42 further serve to tension the web 2 between the nozzle 24 of the paster 22 and the peripheral surface 40 of the counterknife 36.

FIG. 1 further shows an oscillator 44 which is adjacent the path of the web 2 between the deflecting rollers 26, 28 and is provided with web-engaging lobes. The operation of this oscillator is synchronized with those of the rotary parts 32, 36 of the severing unit 30 so that the web 2 is held against forward movement for a short interval of time following each cut across the running web 2. This ensures the establishment of a predetermined narrow clearance between the trailing end of each freshly separated uniting band 39 and the immediately following leader of the remaining part of the web 2. It will be seen that the, oscillator 44 converts the continuous forward movement of the leader of the web 2 toward the paster 22 into intermittent forward movements of successive leaders of the web 2 toward the severing unit 30. The operation of the oscillator 44 is or can be identical with or analogous to that of the oscillator disclosed in U.S. Pat. No. 5,054,346 granted Oct. 8, 1991 to Heitmann for "APPARATUS FOR REPEATEDLY SEVERING RUNNING WEBS OF TIPPING PAPER AND THE LIKE".

Prior to the application of adhesive by nozzle 24, successive increments of the running web 2 advance past the sensor 16 which, as already mentioned above, is installed at a predetermined distance from the orifice(s) of the nozzle 24. The sensor 16 transmits, via conductor 16*a*, to the control unit 50 signals at a frequency depending upon the speed of lengthwise movement of the web 2 and the distances between successive patterns 18 of perforations in the web. As also mentioned hereinbefore, the sensor 16 need not directly monitor the patters 18 but can monitor instead suitable indicia or symbols or markers 19 which advance with the web 2 and each of which is positioned at the same distance relative to the associated or nearest pattern 18. For example, such indicia can be applied to or otherwise borne by the web 2 in alignment with the leading end of each of a series of patterns 18 in one of the two rows of patterns shown in FIG. 2.

The indicia 19 can be scanned in addition to or in lieu of scanning of one of the upper and lower rows of paterns 18 shown in FIG. 2. For example, the indicia 19 can be designed and/or colored and/or dimensioned and/or otherwise designed in such a way that they can be more readily and/or more reliably detected than the respective patterns 18 and/or that they can be reliably detected by a sensor which is simpler and hence less expensive and less prone to malfunction than a sensor which monitors the permeabilities and/or reflectivities of successive patterns 18. The signals which are transmitted by the sensor 16 via conductor means 16*a* can be simply stored by the control unit 50 or are processed by this unit into signals which can be more readily compared with other signals. The control unit 50 can comprise a microcomputer and one or more memories for the storage of incoming and/or processed signals.

A second sensor 52 cooperates with a timer disc 51 to generate a series of second signals denoting the frequency at which the unit 30 severs the web 2 in response to penetration of successive knives 34 into registering peripheral recesses 38 of the counterknife 36, i.e., the frequency of the making of successive discrete uniting bands 39. Such signals are transmitted to the corresponding input of the control unit 50 via conductor means 52*a*. For example, the sensor 52 can constitute a conventional proximity detector which generates a signal whenever a projection 51*a* of the timer disc 51 comes sufficiently close to this sensor, i.e., when a knife 34 is in the process of or has completed the severing of a uniting band 39 from the immediately following portion of the leader of the running web 2.

The control unit 50 compares the phases of the sequence of first signals (from the sensor 16) with the phases of second signals (from the sensor 52) and generates (third) signals when the first signals are out of phase with the second signals. If the signals are out of phase relative to a predetermined reference value, the output of the control unit 50 transmits a signal via conductor means 53 to temporarily alter the RPM of the output element of the prime mover 11, which selects the speed of forward movement of the web 2, by selecting the RPM of the driver roll 6. The result of such short-lasting change of RPM of the roll 6 is that the speed of forward movement of the web 2 is again in an optimum relationship with the frequency at which the web is being severed by the unit 30.

The outcome of the just described adjustment (when required due to unsatisfactory relationship between the first signals from the sensor 16 and the second signals from the sensor 52) is that the speed of forward movement of the web 2 is related to the timing of successive cuts being made by successive knives on the carrier 32 with a view to ensure proper (optimum) selection of the cuts being made transversely across the second sections 18*a* of the web 2. This, in turn, ensures the making of short or long series of filter cigarettes each of which offers a desired resistance to the inflow of atmospheric air into the column of tobacco smoke when the filter cigarette is lighted. Thus, even though the oscillator 44 can vary the lengths of successive sections of the web 2 which advance between successive cuts across the running web, nevertheless the overall length of each uniting band 39 is the same and each pattern 18 is invariably located at the same distance from the front and trailing ends of the respective unitig band 39, i.e., each pattern 18 is located at the same distance from the leading and trailing ends of the respective uniting band. This brings about the advantage that each uniting band 39 is provided with an adhesive-coated surface portion which matches (in size and shape) that on each other uniting band. This is achieved without necessitating any further monitoring of the positions of patterns 18 relative to the nozzle 24 of the paster 22.

A further output of the control unit 50 is connected with the paster 22 by a conductor 54 to transmit signals which cause a valve (not shown) of or in the nozzle 24 to properly relate the timing of the application of adhesive to the adjacent portion of the running web 2 to (namely in synchronism with) the timing of penetration of successive knives 34 into the oncoming recesses 38 of the counterknife 36. If the paster 22 includes a roller-shaped or drum-shaped rotary adhesive applicator, such applicator can be kinematically coupled with the prime mover of the apparatus 1, i.e., with the prime mover which rotates the knife carrier 32 and the counterknife 36 of the severing unit 30 and, if necessary, the shaft 5 for the bobbin 4.

In the apparatus 1 of FIG. 1, the web 2 which is convoluted around the core of the bobbin 4 is already provided with a file of spaced-apart successive patterns 18 separated from each other by non-perforated portions 18*a* of the web. Such perforations can be provided in the web 2 during advancement through a perforating apparatus of the type disclosed, for example, in the aforementioned U.S. Pat. No. 4,281,670 to Heitmann et al. or in the aforementioned U.S. Pat. No. 4,889,140 to Lorenzen et al.

Figure 3:
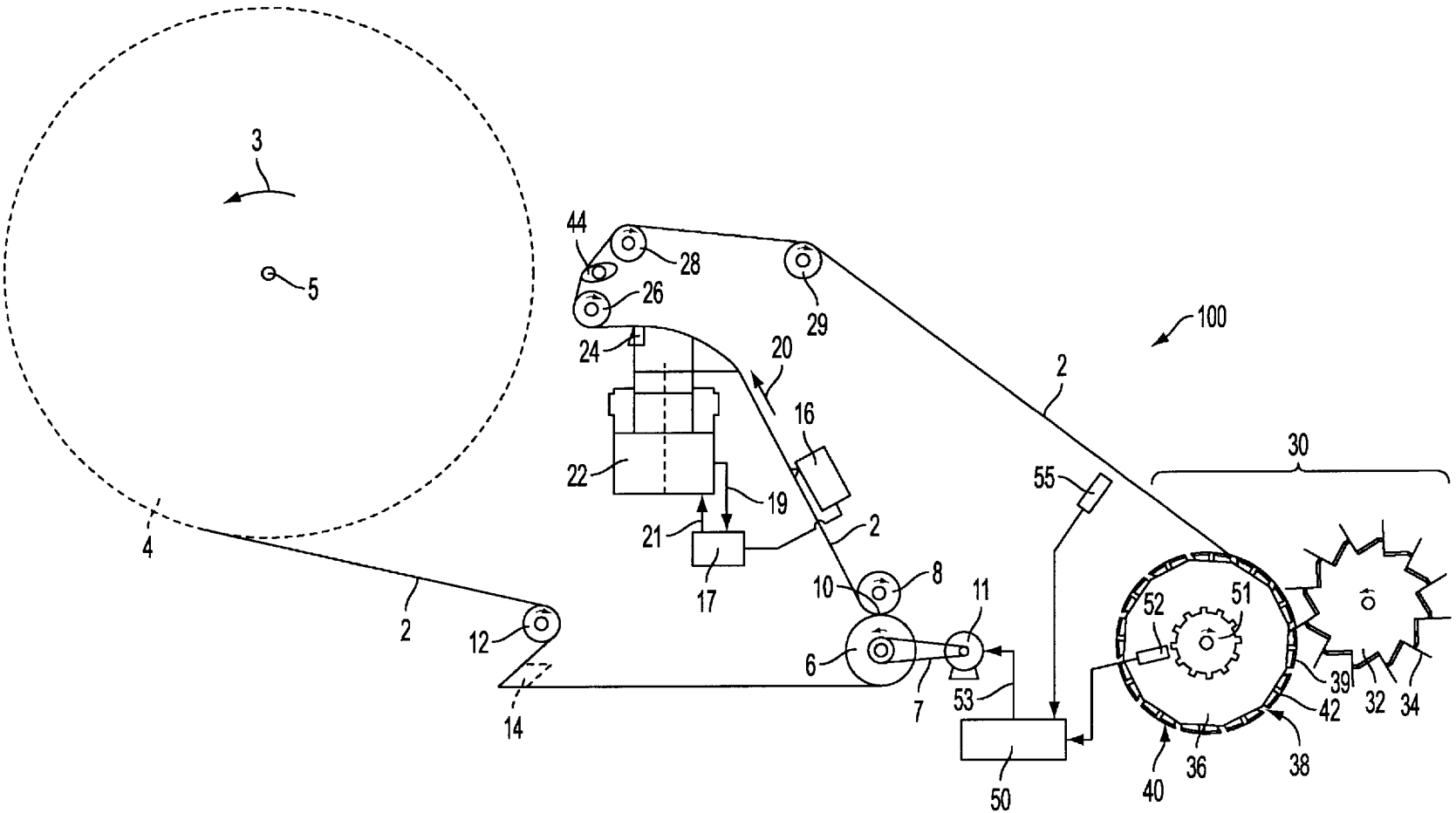
FIG. 3 is an elevational view similar to that of FIG. 1 but showing a modified apparatus for the application of adhesive to a running web of wrapping material for a rod-like filler of filter material for tobacco smoke.

Referring to FIG. 3, there is shown an apparatus 100 which forms part of a modified filter tipping machine, i.e., which constitutes a modification of the apparatus 1 shown in FIG. 1. All such parts of the apparatus 100 which are identical with or plainly analogous to those in the apparatus 1 of FIG. 1 are denoted by similar reference characters.

The apparatus 100 comprises a further sensor or detector 55 adjacent that portion of the path for the web 2 which extends from the nozzle 24 of the paster 22 toward the severing unit 30 and serves to generate signals upon detection of successive patterns 18 (not shown in FIG. 3) or to generate signals upon detection of successive indicia 19 of the type described with reference to FIG. 2. An advantage of the apparatus 100 is that it can operate satisfactorily even if the length(s) L of one or more web portions between the upstream ends of successive patterns 18 deviates or deviate from a standard length. The reason is that the sensor 55 can be placed close or very close to the severing unit 30 so that eventual departures of the length(s) of one or more successive not-yet-separated uniting bands 39 from a standard length still remain within an acceptable tolerance range.

Alternatively, such tolerances can be compensated for by measuring the lengths or distances L and by altering the speed of the web 2 when the monitored lengths L depart from a desired standard length. This can be readily accomplished by utilizing a sensor 16 which (as already mentioned hereinbefore) serves to monitor the speed of lengthwise movement of the running web 2.

It Will be seen that, in the apparatus 100 of FIG. 3, one generates two series of first signals denoting the sequence of perforated patterns 18. However, only the signals being generated by the sensors 52 and 55 are transmitted to the corresponding inputs of the control unit 50. The latter processes such signals in a manner as described with reference to FIG. 1 in connection with the signals from the sensors 16 and 52.

The signals which are generated by the sensor 16 are transmitted to a second control unit 17. The latter receives signals (via conductor 17*a*) from the paster 22; such signals denote the frequency of application of adhesive to the running web 2 by the nozzle 24. If the phase difference existing between the signals from the sensor 16 and the signals from the paster 22 is outside of a predetermined tolerance range, the control unit 17 transmits a signal via conductor 21 to alter the frequency of application of adhesive by the nozzle 24.

The improved method of the present invention is based an the recognition that, when the length of the path for advancement of the web 2 between the nozzle 24 of the paster 22 and the severing unit 30 is to remain constant, it suffices to fix the paster and the severing unit in selected positions relative to each other upon an initial single adjustment. All that is necessary is to select predetermined values for the phase difference between the frequency of arrival of perforated patterns 18, the frequency at which the knives 34 of the severing unit 30 cut across the web 2, and the forward speed of the web. The forward speed of the web 2 is dependent upon the required or momentary output of the tipping machine which processes the uniting bands 39 being supplied by the counterknife 36 of the severing unit 30.

Once the just described adjustments are completed, the improved method renders it possible to carry out any additional required adjustments exclusively by changing (at 11) the speed of forward movement of the web 2, i.e., the operation of the paster 22 and the operation of the severing unit 30 can remain unchanged while the operating speed of the tipping machine remains unchanged. It will be seen that the just described embodiment of the improved method and the apparatus for the practice of such method render it possible to ensure, at a relatively low cost, that the positions of the patterns 18 as well as the positions of the adhesive-coated portions 18*a* of the running web 2 are properly related to each other as well as to the locus of actual cut across the web 2, i.e., the locus of the recess 38 which receives the cutting edge of one of the knives 34.

On the other hand, and as shown in FIG. 3, if one ascertains (at 16) the positions of the patterns 18 ahead of the path portion where the nozzle 24 applies a succession of adhesive films to the sections 18*a* of the running web, and if one thereupon synchronizes (at 17) the application of adhesive with the then positions of the sections 18*a,* the synchronizing of perforated patterns 18 with the applied adhesive films is carried out automatically, without the need for additional monitoring and adjustments, due to the aforediscussed initially selected relationship between the frequency at which the knives 34 sever the web 2, the frequency of arrival of perforated patterns 18, and the forward speed of the web.

An important advantage of the feature that the improved apparatus 1 and 100 comprise means (50, 11) for temporarily changing the speed of forward movement of the web 2 is that this simple expedient renders it possible to position the perforated sections 18A of the web in synchronism with the severing unit 30.

An advantage of the feature that the speed of forward movement of the web 2 is altered only when the departure of phase positions from a predetermined or preselected value exceeds a preselected tolerance range is that one avoids unnecessary (or not absolutely necessary) adjustments of the positions of successive sections 18A relative to the severing unit 30, i.e., adjustments for those departures of phase lengths which are within an acceptable range of tolerances.

An advantage of the feature that the detection of perforated sections 18A and/or of the symbols 19 takes place simultaneously with the detection of distances L between successive sections 18A is that this renders it possible to even more accurately determine the need or the absence of need for adjustments of the speed of forward movement of the web. In other words, such undertakings render it possible to even more reliably ascertain whether or not the detected departures of one or more variables from predetermined optimum values are or are not within acceptable tolerance ranges. In addition, such undertaking render it possible to compensate for an additional possible or potential departure from an optimum value, namely for departure of distances or spacings between successive sections 18A or symbols 19 from an optimum distance.

As concerns the advantages of the improved method and apparatus over the conventional methods and apparatus, it is now no longer necessary to readjust the filter cigarette making machine at the time of each insertion of a fresh bobbin 4, i.e., upon expiration of the bobbin which is actually borne by the shaft 5 of the filter cigarette making machine (such as a machine know as MAX and distributed by the assignee of the present application). All that is now necessary to compensate for departure of distances between successive perforated sections 18A from prescribed distances (normally 27 mm) is to carry out the aforedescribed adjustment only when the distances L between successive sections 18A of the web 2 on a freshy inserted bobbin 4 depart from the spacing between the sections 18A of the gab on the bobbin which was utilized to effect the initial (original) setting of the apparatus that supplies uniting bands 39 in the filter cigarette making machine. Such undertakings cannot be carried out in presently known apparatus. For example, the aforediscussed U.S. Pat. No. 5,735,292 to Draghetti proposes to change the length of the path for the running web between the paster and the severing unit. The extent of such adjustment is necessarily limited. Furthermore, each and every adjustment (via cylinder 14 and the associated parts) in the machine of Draghetti necessitates a long-lasting stoppage of the patented cigarette making machine. Such adjustments must be carried out whenever a preceding (expired) bobbin is to be replaced with a fresh bobbin wherein the spacing between successive perforated sections departs from that between the perforated sections in the web on a bobbin which was utilized to effect the original setting of the patented machine. It is to be noted that, when the spacing between successive perforated sections of the web borne by a preceding bobbin departs from the spacing between successive perforated sections of the web being convoluted around the core of a fresh bobbin, even relatively minor differences between the two spacings necessitate an adjustment of the filter cigarette making machine because the differances between the spacings of successive perforated sections of the web carried by a new or fresh bobbin add up so that their sum invariably exceeds the range of acceptable tolerances. Thus, and referring to a bobbin which, as a rule stores a supply of convoluted fresh web having a length of 3000 meters or thereabout, the number of perforated sections 18*a* in such web is evidently well above that number which necessitates an adjustment of the web manipulating apparatus, even if the departure of distances between successive perforated sections is extremely small. The necessary compensations are carried out automatically without the need for a stoppage of the filter cigarette making machine if such machine utilizes web manipulating apparatus embodying the present invention.

An advantages of a sensor (16) which can monitor the running web 2 for the presence of successive sections 18A or symbols 19, as welt as for a determination of the distances L (i.e., of the combined lengths of successive sections 18A plus one of the adjacent sections 18*a*) is that this contributes to lower cost and to reduced space requirements of the improved apparatus and to simplicity of the improved method.

It is presently preferred to install the sensor 55 downstream of the paster 22, upstream of the severing unit 30 and close or very close to the severing station where successive knives 34 penetrate into the oncoming recesses 38. Such arrangement also contributes to simplicity and reliability of compensation for departures of the distances L from desired or prescribed distances.

The spacing of the sensor 55 from the nozzle 24 is a fixed distance, the same as that between the sensor 55 and the severing station. The distance of the sensor 55 from the severing station of the unit 30 need not exceed the combined length of a small or relatively small number of successive sections 18A plus the combined length of the sections 18*a* therebetween. This sensor is set up to finish the "first" signals. Such mounting of the sensor 55 in close proximity to the severing station ensures that the motor 11 cannot react prematurely because the combined deviation of a relatively small number of distances L is very unlikely to exceed the range of acceptable deviations. In order to ensure that such embodiment (shown in FIGS. 3) can also guarantee proper synchronization of the operation of the paster 22 with that of the severing unit 30, one employs the sensor 16 which transmits signals to the second control unit 17. This sensor 16 is installed upstream of the paster 22 and serves to detect the sections 18A and/or the symbols 19. The "first" signals being transmitted by the sensor 16 of FIG. 3 are compared with signals (transmitted via conductor means 9) which denote the frequency of adhesive application to the sections 18*a* of the running web 2 by the nozzle 24. Thus, in the embodiment of FIG. 3, the sensor means and the associated control means ensure proper synchronization of the operation of the paster 22 with that of the severing unit 30. This is accomplished in that the sensor 55 (i.e., the sensor which is located downstream of the paster but upstream of the severing unit) alters the speed of the web 2 (via control unit 50 and it cooperation with the sensor 52). A synchronization of the rate of arrival of sections 18A with the frequency of application of adhesive by the nozzle 24 is effected by the sensor 16 in conjunction with the control unit 17, i.e., by the sensor which monitor the running web 2 upstream of the paster 22.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of applying adhesive to running webs of wrapping material for rod-shaped smokers' products and, therefore, such adaptations should and are intended to be comprehended within the meaning and range of equivalence of the appended claims.

What is claimed is:

1. Apparatus for supplying a series of discrete perforated uniting bands of tipping material to a filter cigarette machine, comprising:

means for advancing in a predetermined direction and along a predetermined path an elongated web which consists of tipping paper and is provided with a series of perforated first sections alternating with non-perforated second sections;

means for applying a flowable adhesive to successive second sections of the web in a first portion of said path;

means for severing the web across successive second sections of the web in a second portion of said path downstream of said first portion to thus convert the web into a succession of discrete uniting bands;

at least one first sensor adjacent a third portion of said path upstream of said second portion and arranged to generate first signals denoting detection of successive first sections of the web;

at least one second sensor arranged to monitor the frequency of severing the web in said second portion of said path and to generate second signals denoting the frequency of severing the web;

control means including means for comparing said first and second signals; and means for altering the speed of advancement of the web when a comparison of said first and second signals reveals deviations outside of a predetermined range.

2. The apparatus of claim 1, wherein said first and second portions of said path are disposed at a fixed distance from each other.

3. The apparatus of claim 1, further comprising means for ascertaining distances between successive first sections of the web and means for comparing the ascertained distances with a reference distance, said altering means being arranged to temporarily alter the speed of advancement of the web in dependency upon a comparison of the ascertained distances with the reference distance.

4. The apparatus of claim 3, wherein said means for ascertaining said distance is part of said at least one first sensor.

5. The apparatus of claim 3, wherein said means for comparing the ascertained distance forms part of said control means.

6. The apparatus of claim 1, wherein said third portion of said path is located at a first fixed distance from and downstream of said first portion of said path and at a second fixed distance from and upstream of said second portion of said path.

7. The apparatus of claim 1, wherein said advancing means comprises at least one rotary advancing roll having a peripheral surface arranged to contact and entrain the web in said predetermined direction, said means for altering the speed of advancement of the web including means for varying a peripheral speed of said at least one roll.

8. The apparatus of claim 1, further comprising at least one third sensor arranged to generate third signals denoting the frequency of application of flowable adhesive to successive second sections of the web, means for comparing said third signals with said first signals, and means for temporarily altering the frequency of application of adhesive to the second sections of the web based on a comparison of said first and third signals.

9. The apparatus of claim 8, wherein said control means includes means for comparing said first signals only with said second signals.

10. The apparatus of claim 8, wherein said at least one third sensor is disposed at a portion of said path between said first and second portions.

11. The apparatus of claim 1, wherein at least one of said sensors is selected from the group consisting of photoelectric and proximity detectors.

12. The apparatus of claim 11, wherein the altering means comprises means for altering the speed of the advancing means.

13. The apparatus of claim 1, wherein the altering means comprises means for permanently changing the speed of the advancement of the web until the comparison of the first and second signals again reveals the presence of deviations outside of the predetermined range.

14. The apparatus of claim 1, wherein the altering means comprises means for altering the speed of the web from a first continuous speed to a second continuous speed.

15. Apparatus for supplying a series of discrete perforated uniting bands of tipping material to a filter cigarette machine, comprising:

means for advancing in a predetermined direction and along a predetermined path an elongated web which consists of tipping paper and is provided with a series of perforated first sections alternating with non-perforated second sections;

means for applying a flowable adhesive to successive second sections of the web in a first portion of said path;

means for severing the web across successive second sections of the web in a second portion of said path downstream of said first portion to thus convert the web into a succession of discrete uniting bands;

at least one first sensor adjacent a third portion of said path upstream of said second portion and arranged to generate first signals denoting detection of successive first sections of the web;

at least one second sensor arranged to monitor the frequency of severing the web in said second portion of said path and to generate second signals denoting the frequency of severing the web;

control means including means for comparing said first and second signals; and means for temporarily altering the speed of advancement of the web when a comparisons of said first and second signals reveals deviations outside of a predetermined range;

at least one third sensor arranged to generate third signals denoting the frequency of application of flowable adhesive to successive second sections of the web;

means for comparing said third signals with said first signals; and means for temporarily altering the frequency of application of adhesive to the second sections of the web based on a comparison of said first and third signals.

16. The apparatus of claim 15, wherein said control means includes means for comparing said first signals only with said second signals.

17. The apparatus of claim 15, wherein at least one third sensor is disposed at a portion of said path between said first and second portions.

* * * * *